US006585400B2

(12) United States Patent
Leen

(10) Patent No.: US 6,585,400 B2
(45) Date of Patent: Jul. 1, 2003

(54) MULTI-ADJUSTABLE CLAMP WORK LIGHT

(76) Inventor: Monte A. Leen, 11730 NE. 12th St., Bellevue, WA (US) 98005

( * ) Notice: Subject to any disclaimer, the term of this patent is extended or adjusted under 35 U.S.C. 154(b) by 0 days.

(21) Appl. No.: 09/900,615

(22) Filed: Jul. 6, 2001

(65) Prior Publication Data

US 2003/0007355 A1 Jan. 9, 2003

(51) Int. Cl.[7] ..... F21S 8/08; F21V 19/02

(52) U.S. Cl. ..... 362/418; 362/413; 362/427; 362/419; 362/371; 362/581

(58) Field of Search ..... 362/413, 427, 362/418, 419, 581, 371

(56) References Cited

U.S. PATENT DOCUMENTS

| | | | | | |
|---|---|---|---|---|---|
| 1,562,994 | A | * | 11/1925 | Stewart | |
| 1,722,773 | A | * | 7/1929 | Stewart | |
| D204,792 | S | * | 5/1966 | Collings | D48/20 |
| 4,494,177 | A | * | 1/1985 | Matthews | 362/402 |
| 4,678,153 | A | | 7/1987 | Maddock et al. | 248/229 |
| 5,209,562 | A | | 5/1993 | Glassford | 362/378 |
| D348,743 | S | | 7/1994 | Leen et al. | D26/60 |
| 5,400,234 | A | * | 3/1995 | Yu | 362/386 |
| 5,414,608 | A | * | 5/1995 | Stekelenburg | 362/396 |
| 5,448,463 | A | | 9/1995 | Leen | 362/396 |
| 5,510,970 | A | * | 4/1996 | Hollenbach et al. | 362/396 |
| 5,690,416 | A | * | 11/1997 | Van Gennep | 362/191 |
| 5,833,359 | A | | 11/1998 | Hollenbach | 362/250 |

* cited by examiner

*Primary Examiner*—Sandra O'Shea
*Assistant Examiner*—Jacob Y. Choi
(74) *Attorney, Agent, or Firm*—Dean A. Craine

(57) ABSTRACT

A multi-adjustable clamp work light comprising an elongated hollow grip handle, a light housing pivotally mounted to one end of the grip handle, an adjustable clamp member, and a two-way adjustable joint disposed between the clamp member and the grip handle. An optional hook may also be provided.

6 Claims, 6 Drawing Sheets

MULTI-ADJUSTABLE CLAMP WORK LIGHT

BACKGROUND OF THE INVENTION

1. Field of the Invention

This invention relates to work lights and, more particularly, to adjustable work lights capable of being clamped to a surface.

2. Description of the Related Art

In the past, a wide variety of portable work lights have been developed for use as trouble lights, workbench lights, automobile repair work lights, etc. The most common work light used in such environments is the conventional trouble light which uses an incandescent or halogen bulb mounted in a socket surrounded by a protective shroud. A fixed hook is mounted on the top of the shroud so that the work light may be hung from a nail or hook.

More recently, a variety of portable work lights have been developed that use a light housing mounted at one end of an elongated support member that can be used as a grip handle. The light housing is designed to pivot up and down or rotate around one end of the support member. Fixed or pivotally mounted to the opposite end of the support member is a clamp. A hook may also be attached to one end of the support member so that the work light may be hung from an object or surface.

While the above referenced portable work lights have improved the workman's ability to attach a work light to different surfaces or objects and to direct the light to a desired area on the workspace, movement of the light housing, the clamp, and the hook are limited so that the work light can be adjusted only along two axes. What is needed is a work light that can be adjusted along three axes.

SUMMARY OF THE INVENTION

It is an object of the invention to provide a portable work light with an elongated grip handle for easy handling, a pivotal light housing attached at one end on the grip handle, and an single hand operated, adjustable clamp member attached to the opposite end of the grip handle.

It is another object of the invention to provide such a portable work light in which the light housing may be adjusted along one axis, and the clamp member may be adjusted along two different axes, thereby providing a work light capable of being adjusted along three axes.

These and other objects of the present invention are met by a portable work light comprising an elongated grip handle, a light housing pivotally mounted to the proximal end of the grip handle, a two-axis adjustable joint disposed at the opposite, distal end of the grip handle, and an adjustable clamp member attached to the two-axes adjustable joint. Such a work light enables the user to finely adjust and lock the work light in position along three different axes so that the desired work area is illuminated. An optional hook may also be provided that pivotally attaches either to the joint used to attach the light housing to the grip handle or to the two-axes adjustable joint on the grip handle There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DESCRIPTION OF THE PREFERRED EMBODIMENT(S)

Figure 1:
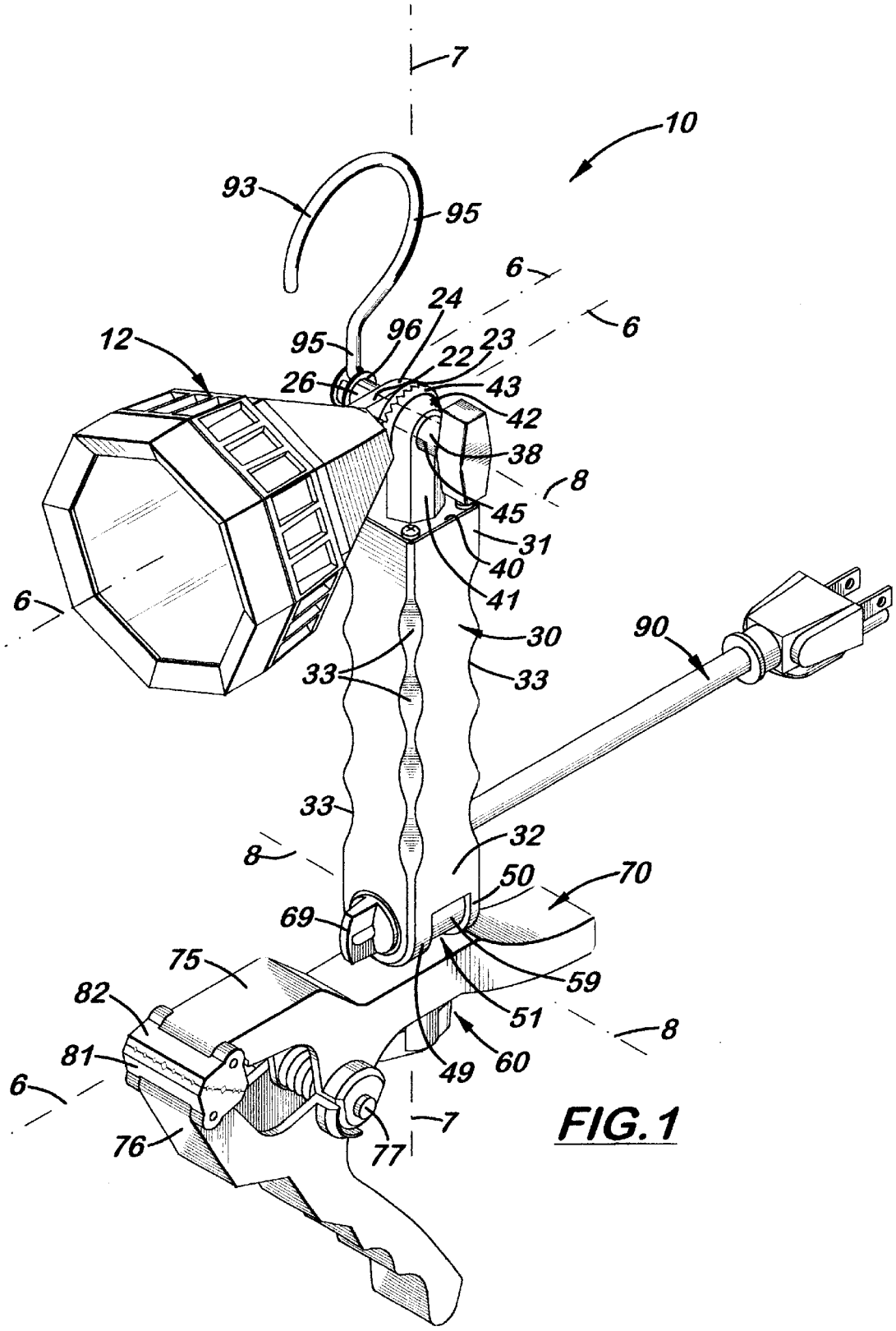
FIG. 1 is a perspective view of the multi-adjustable clamp work light disclosed herein.

As shown in FIGS. 1–9, there is shown a multi-adjustable clamp work light 10 that includes an elongated grip handle 30, a light housing 12 pivotally mounted to the proximal end 31 of the grip handle 30, an adjustable clamp member 70, and a two-axes adjustable joint 60 disposed between the clamp member 70 and the distal end 32 of the grip handle 30. The pivoting movement of the light housing 12 and the two-axes adjustable joint 60 enables the user to finely adjust the work light 10 along three different axes for greater utility.

Figure 5:
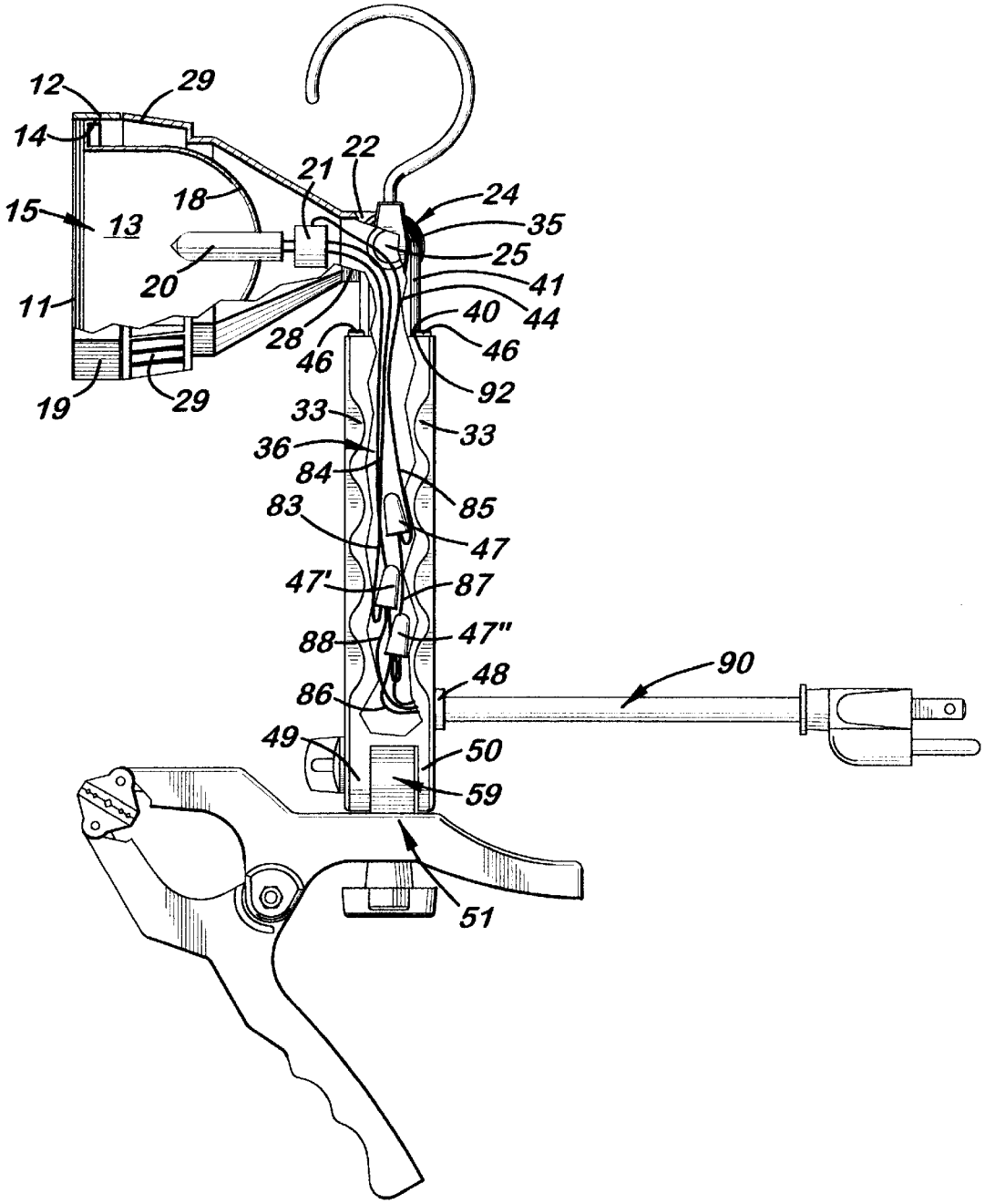
FIG. 5 is a sectional side elevational view of the work light.

As shown in FIG. 5, mounted inside the light housing cavity 13 is a bulb connecting means capable of connecting to an electric bulb 20. The electric bulb connecting means may be a standard socket 21 designed to attach to a standard halogen bulb or an incandescent or fluorescent bulb. Disposed inside the cavity 13 and around the bulb 20 is a conical-shaped reflector 18 designed to reflect light outward through the light housing front opening 15. In the preferred embodiment, the light housing 12 is an octagonal, conical shape body with a circular front opening 15.

Formed around the front opening 15 of the light housing 12 are external threads 14 designed to engage complimentary-shaped internal threads (not shown) formed on an octagonal-shaped cap 19. Mounted inside the cap 19 is a clear or frosted lens 11. An optional insulating rubber collar 29 fits around the outer surface of the light housing 12 adjacent to the front opening 15.

Formed on the apex of the light housing 12 is a rearward extending connection arm 22. The connection arm 22 is hollow with a longitudinally aligned passageway 28 formed therein that communicates with the cavity 13 located inside the light housing 12. Formed on the distal end of the connection arm 22 is a semi-spherical shaped body 24 with an inner cavity 25. As shown more clearly in FIG. 1, formed on the body 24 is a circular, laterally disposed opening with a first set of gear teeth 23 formed therearound. Integrally formed on the body 24 is a laterally projecting neck 26 with a bore not shown 7 formed therein that communicates with the inner cavity 25.

Selectively attached to the connection arm 22 is the grip handle 30. The grip handle 30 includes a removable end cap 40. The end cap 40 includes a perpendicularly aligned, hollow post member 41 attached to thereto. The post member 41 is similar in cross-section to the connection arm 22 with a longitudinally aligned flat surface and a semi-spherical shaped body 42. Formed on the body 42 is a laterally disposed opening with a second set of gear teeth 43 formed therearound. The second set of gear teeth 43 are complimentary in shape with the first set of gear teeth 23 formed on the connection arm 22. As shown more clearly in FIG. 5, formed inside the post member 41 is a central passageway 44. Also formed on the body 42 is a laterally projecting hollow neck 45.

During assembly, the end cap 40 is attached to the proximal end 31 of the grip handle 30 via suitable threaded connectors 46. The distal ends of the connection arm 22 and post member 41 are then overlapped so that the first and second set of gears 23, 43 are meshed together and the necks 26 and 45 and their respective bores (not shown) are aligned and registered. A threaded bolt 38 is inserted into the bores formed in the connection arm 22 and the post member 41 to pivotally connect them together. A separate nut (not shown) is attached to the distal end of the threaded bolt 38 so that the threaded bolt 38 may be tightened to lock the connecting arm 22 and post member 41 together to hold the light housing 12 at desired angle with respect to the grip handle 30. Disposed inside the two bodies 24, 42 is an optional rubber bushing 35, designed to provide a water-tight seal between the two enjoining parts.

The grip handle 30 is a hollow handle structure with a longitudinally aligned passageway 36 formed therein. In the preferred embodiment, the grip handle 30 is a square in cross-section with optional recessed finger grip indentations 33 formed along its four longitudinally aligned edges. Formed on the distal end 32 of the grip handle 30 are two parallel longitudinally aligned arms 49, 50 which are spaced apart, thereby forming a receiving space 51 designed to receive an adapter 59 discussed further below. Formed on one side wall of the grip handle 30 near the distal end 32 is a wire bushing 48 through which a power cord 90 is extended. The power cord 90 includes a "hot" wire 86 (black), a "neutral" wire (white) 87, and a "ground" wire 88 (green) that are connected via wire nuts 47 to complementary wires connected to the socket 21.

As shown in FIGS. 6–9, formed on the grip handle first arm 49 is a lock bushing receiving bore 52 designed to receive a lock bushing 53. Formed coaxially inside bore 52 is a small square shaped opening 62. The lock bushing 53 includes a square shaped body portion 54 with a raised neck 55 integrally formed thereon. Disposed between the body portion 54 and the neck 55 is a circular ring 64 slightly wider in diameter than the body portion 54 and neck 55. Also, formed on the side of the body portion 54 opposite the neck 55 is a circular aligned set of gear teeth 56 designed to engage complimentary circular aligned gear teeth 61 formed on the rear surface 67 of the adapter 59 discussed further below.

Also, formed inside the lock bushing 53 is a longitudinally aligned opening 58. During assembly, the lock bushing 53 is inserted into the bore 52 so that the body portion 54 fits into the opening 62 formed on the arm 49. The neck 55 extends outward while the circular ring 64 rests against the inside surface of the bore 52 to prevent inward movement of the lock bushing 53 on the first arm 49.

Figure 6:
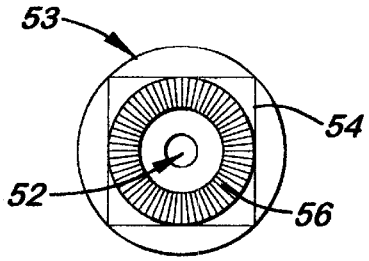
FIG. 6 is a front plan view of the lock bushing.
Figure 7:
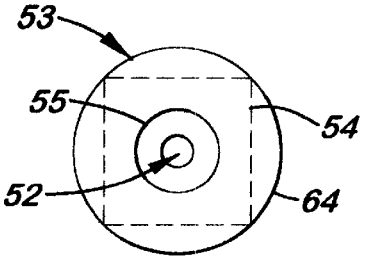
FIG. 7 is a rear plan view of the lock bushing.
Figure 8:
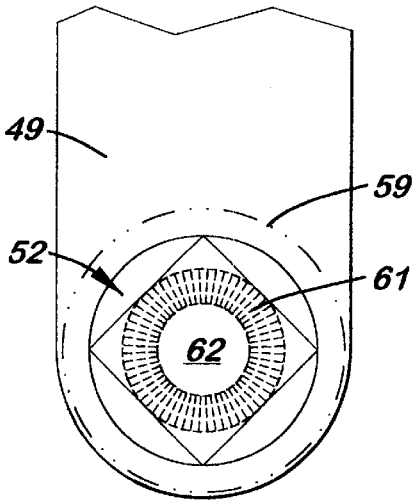
FIG. 8 is a front view of the distal end of the grip handle.
Figure 9:
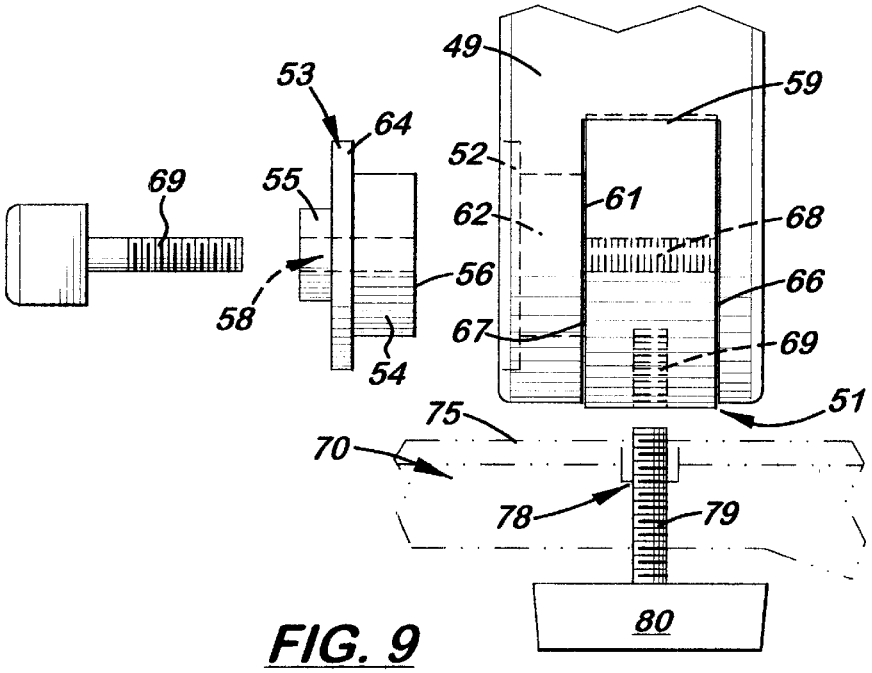
FIG. 9 is an exploded side elevational view of the distal end of the grip handle.

The adapter 59, shown more clearly in FIGS. 6, 7, and 8, is a polygon structure with parallel, flat front and rear surfaces 66, 67. Extending between the front and rear surface 66, 67 is a transversely aligned threaded bore 68. Formed centrally on the lower surface of the adapter 59 is a vertical threaded bore 69 perpendicularly aligned with bore 68. The front surface 66 of the adapter 59 is smooth while the rear surface 67 has a second set of gear teeth 61 designed to mesh with the first set of gear teeth 56 formed on the inside surface of the lock bushing 53. The second set of teeth 61 is co-axially aligned around the first threaded bore 68. The adapter 59 is sufficient in width so that it may be inserted closely into the receiving space 51 formed on the grip handle 30 with the second set of gear teeth 61 placed adjacent to the lock bushing 53. When properly inserted, the bore 68 is aligned and registered with the bore 52 formed on the lock bushing 53. A threaded turn bolt 69 is then inserted into the bores 52, 68 until the sets of gear teeth 56, 61 are meshed together. The bolt 69 is tightened to lock the adapter 59 in the desired axial position on the grip handle 30. The adapter 59 is now able to rotate approximately 270 degrees around the longitudinal axis of the two bores 52, 68.

Attached to the adapter 59 is a spring-loaded, single hand clamp 70 that includes a pair of upper and lower jaws 75, 76 joined together by a pin 77. Formed on the handle section of the upper jaw 75 is a hole 78 through which a threaded bolt 79 is extended. Attached to the distal end of the bolt 79 is a handle 80. The bolt 79 includes external threads that connect to the threaded bore 68 formed on the adapter 59. During assembly, the upper jaw 75 is aligned over the adapter 59 so that the hole 78 is aligned with the bore 68. The bolt 79 may then be extended through the upper jaw 75 to selectively connect the clamp 70 to the adapter 59. The clamp 70 is able to rotate 360 degrees around the bolt's longitudinal axis. Formed on the gripping surfaces of the two jaws 75, 76 are optional swiveling grips 82, 83 respectively.

During assembly, the wires 83–85 from the socket 21 extended through the passageway 28 formed in the connecting arm 22. The end cap 40 is then selected and the wires 83–85 are then inserted there through the end cap 40 and into the grip handle 30. The power cord 90 is then inserted into the power cord wire bushing 48. The ends of the wires 83–85 are then connected to suitable wires 86–88 on the power cord 90 via wire nuts 47, 47', 47". Once connected together, the wires 83–85, 86–88 and wire nuts 47, 47" are then forced into the grip handle cavity 36. A suitable gasket 92 is then placed over the end of the grip handle 30 and end cap 40. The threaded connectors 46 are then used to connect the end cap 40 to the grip handle 30.

The connecting arm 22 is aligned and registered with the post member 41 on the end plate 40 so that gears 23 and 43 are meshed together. The threaded bolt 38 is then inserted into the neck 26, 38 to connect the arm 22 and post member 41 together. The light housing 12 is able to rotate around axis 8.

The adapter 59, clamp 70, and threaded turn bolt 79 are then selected. The threaded bolt 79 is then inserted through the hole 78 formed on the upper jaw 75 on the clamp 70. The adapter 59 is positioned inside the receiving space 51 so that the bores 52, 68 are aligned and registered. The turn bolt 79 is then inserted into the bores 52, 68 and tightened. The clamp 70 is then rotated around axis 6 and 7 to its desired position.

In the embodiment of the invention shown in the FIGS., the light housing 12 is approximately 3 inches wide and 3.5 inches high. The cap 19 is approximately 3 inches in diameter. The grip handle 30 is approximately 7.25 inches long. Each jaw 75, 76 on the clamp 70 is approximately 6 inches in length. The amount of light emitted will be determined by the intensity of the halogen or incandescent bulb. In most instances, a 100-watt bulb is adequate.

Attached to the bolt 38 is an optional hook 93. Preferably, the hook 93 is question-mark-shaped with the upper C-shaped portion 95 covered with a vinyl coating. Integrally formed on the distal end of the C-shaped portion 95 is a lower, straight neck portion 94 which ends in a circle portion 96 which connects via a threaded screw to a threaded bore formed on the outer surface of the neck 26. Washers 99 placed on either side of the circular portion 96 allow the hook 93 to rotate easily.

Figure 2:
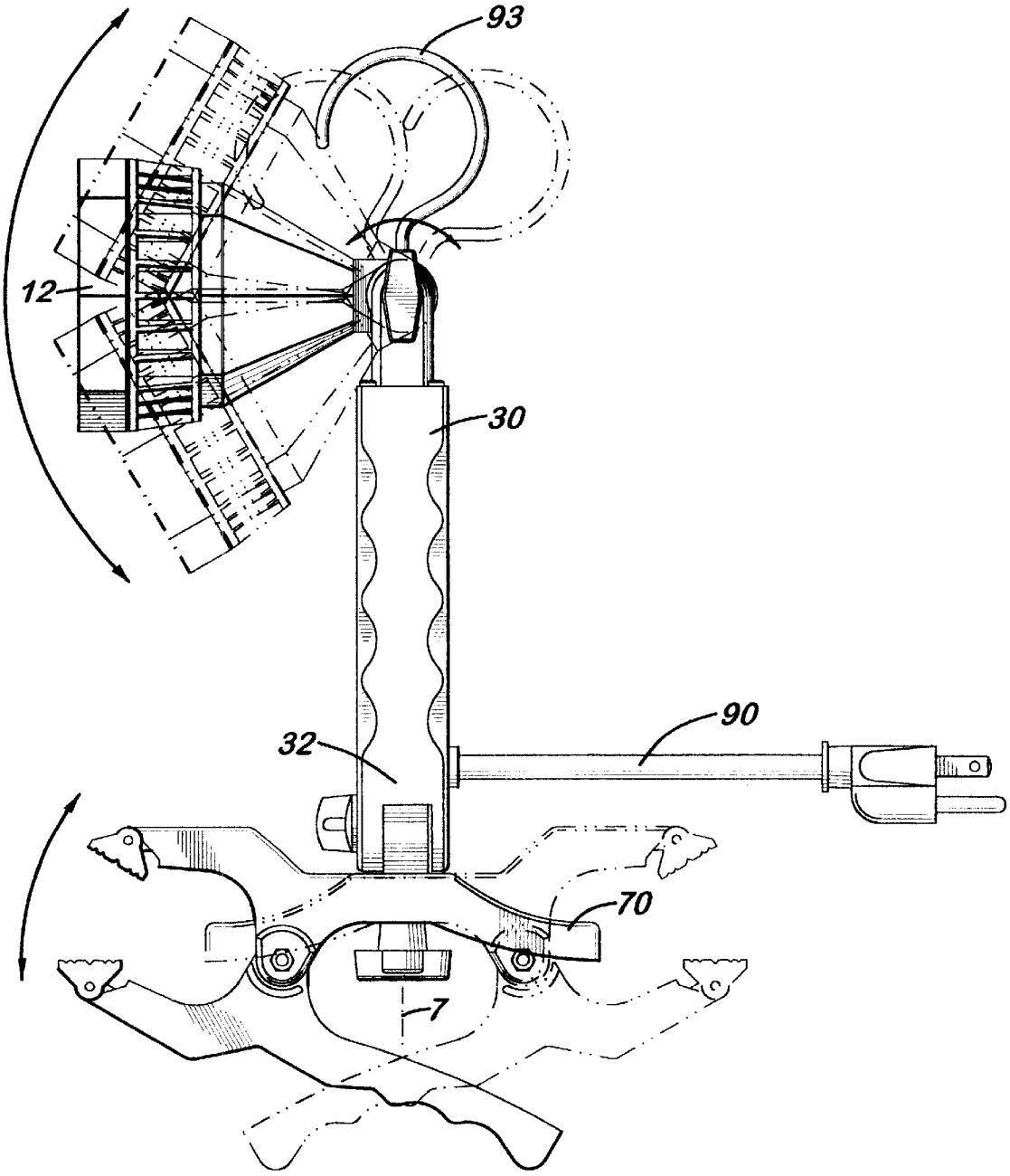
FIG. 2 is a side elevational view of the invention illustrating the pivoting movement of the light housing and the rotational movement of the clamp member on opposite ends of the grip handle.
Figure 3:
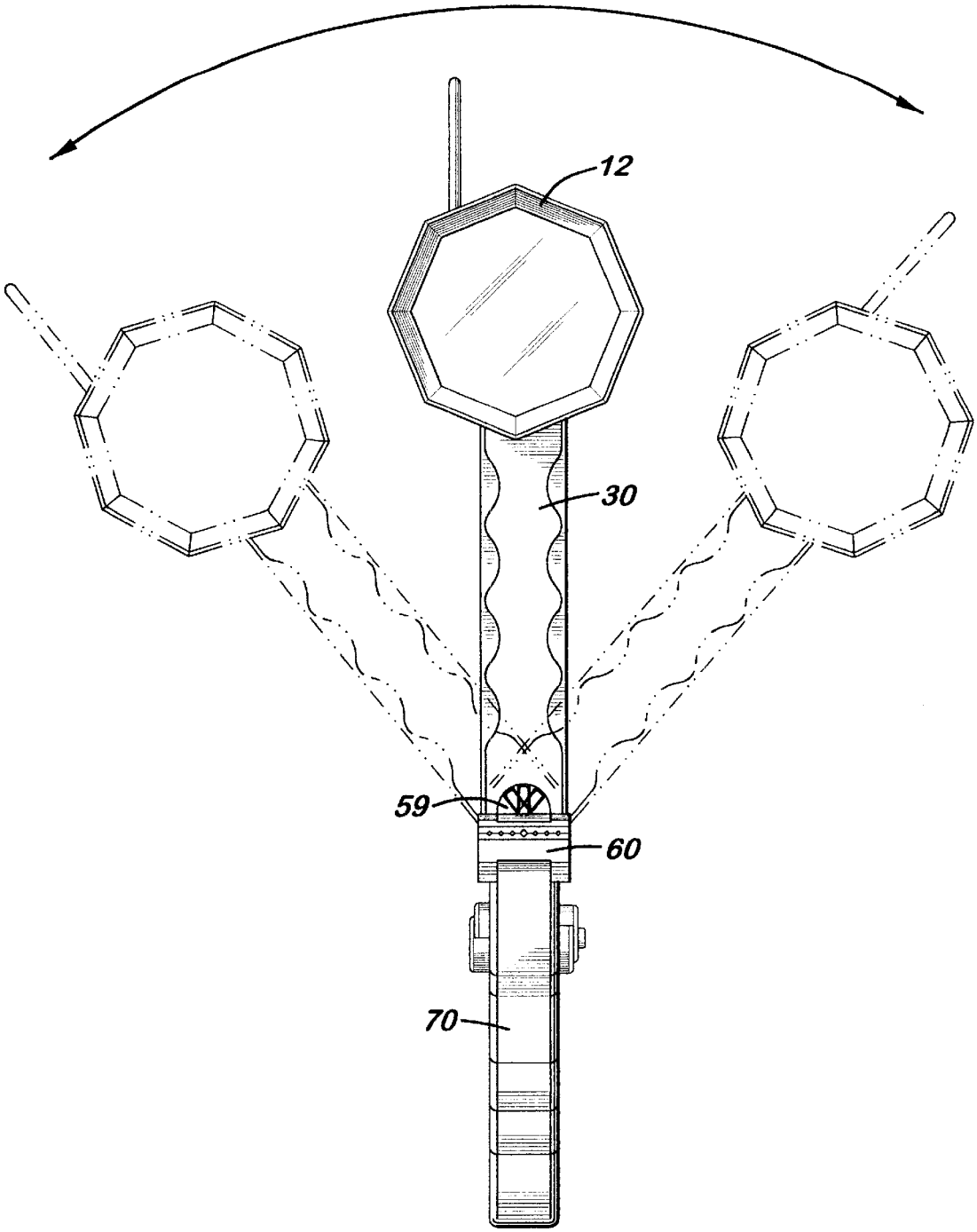
FIG. 3 is a front plan view of the invention illustrating the pivoting movement of the clamp member and the grip member.
Figure 4:
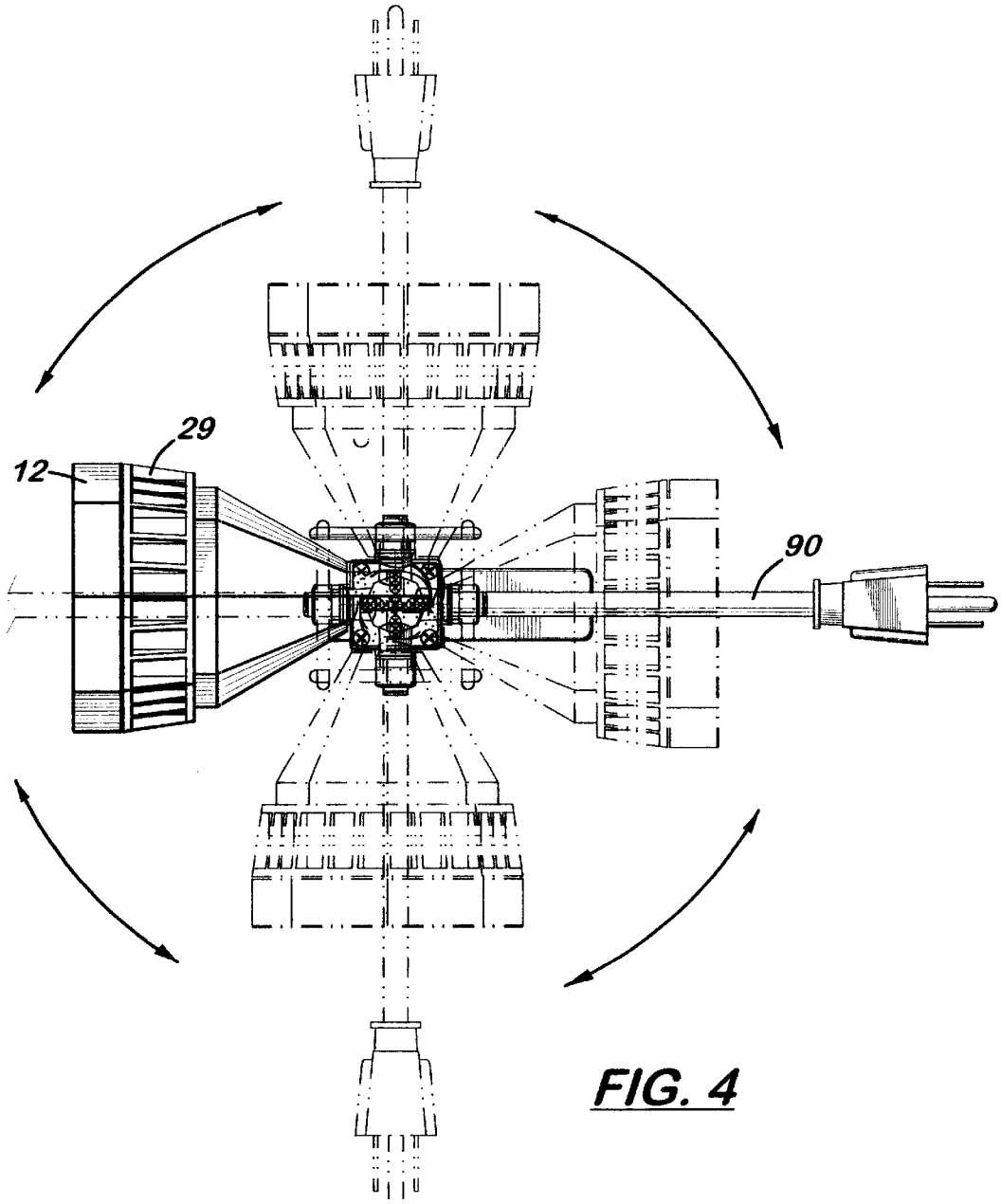
FIG. 4 is a top plan view of the invention illustrating the rotation movement of the grip member on the light housing.

As will be readily appreciated from the foregoing description, the invention provides a portable work light 10 that is relatively small in size, yet has adjustment features that improve the user's ability to aim the light on the work space. The light housing 12 sufficiently small to be easily grasped with one hand and to rotated upward or downward over the proximal end 31 of the grip handle 30. The clamp 70 is also sufficiently small to be easily operated with one hand and provides a strong force that allows the work light 10 to be mounted in almost any position in a variety of locations, as shown in FIGS. 2–4. The adapter 59 is able to rotated approximately 270 degrees and pivot around the grip handle distal end axis 6 and 8, respectively. The clamp 70 is able to be rotated 360 degrees around the grip handle vertical axis 7. The optional collar 29 on the light housing 12 also provides a high friction, insulated layer to protect the user's hand if the light housing 12 needs to be adjusted when hot. The finger indentations 33 on the grip handle 30 provide an improved gripping surface so that the user may hold the work light 10 as the light housing 12 or clamp 70 are repositioned on a support surface.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A multi-adjustable clamp work light comprising:

a. a light including a housing with a front opening, a reflector mounted inside said housing, a bulb mounted inside said housing to shine light through said front opening;

b. an elongated grip handle, said grip handle having a distal end, a proximal end, a lateral axis, a longitudinal axis, a transverse axis;

c. means for pivotally attaching said housing to said proximal end of said grip handle so that said housing may selectively pivot around said lateral axis on said proximal end of said grip handle;

d. an adjustable clamp member;

e. a dual directional adjustable locking joint disposed between said distal end of said grip handle and said clamp member, said locking joint enabling said clamp member to selectively rotate 360° around said longitudinal axis of said grip handle and locked in position after each rotation and selectively pivot 180° around the transverse axis of said grip handle and locked in position; and, f. an electric power cord connected to said bulb mounted inside said housing to provide an electric current thereto.

2. A work light, as recited in claim 1, further including a hook member pivotally attached to said proximal end of said grip handle.

3. A work light, as recited in claim 1, wherein said means for pivotally attaching said housing to said proximal end of said grip handle is a hollow connecting arm extending from said housing and pivotally attached to the proximal end of said grip handle.

4. A multi-adjustable clamp work light comprising:

a. a light including a housing with a front opening, a reflector mounted inside said housing, a bulb mounted inside said housing to shine light through said front opening;

b. an elongated grip handle, said grip handle having a distal end, a proximal end with a recessed space opening, a lateral axis, a longitudinal axis, a transverse axis, and a recessed space opening forward on said distal end;

c. means for pivotally attaching said housing to said proximal end of said grip handle so that said housing may selectively pivot around said lateral axis on said proximal end of said grip handle;

d. an adjustable clamp member;

e. a dual directional adjustable locking joint disposed between said distal end of said grip handle and said clamp member, said adjustable locking joint includes an adapter rotatably mounted inside said recessed space opening on said grip handle, a locking means to lock said adapter in position inside said recessed space opening, said locking joint enabling said clamp member to selectively rotate 360° around the longitudinal axis of said grip handle and selectively pivot 180° around the transverse axis of said grip handle; and, f. an electric power cord connected to said bulb mounted inside said housing to provide an electric current thereto.

5. A work light, as recited in claim 4, wherein said locking means is a pair of circular, gear-patterned surfaces formed on the adjacent surfaces on said grip handle and said adapter and a longitudinally threaded bolt disposed between said adapter and said grip handle used to mesh said gear-patterned surfaces together.

6. A work light, as recited in claim 5, wherein said clamp connecting means includes a threaded bolt, a threaded bore formed inside said adapter, and a bore formed on said clamp member, said threaded bolt being extended through said bore formed on said clamp member and connected to said threaded bore to connect said clamp to said adapter.

* * * * *